US006860402B2

(12) United States Patent
Casuccio

(10) Patent No.: US 6,860,402 B2
(45) Date of Patent: Mar. 1, 2005

(54) AUTOMATIC SINGLE UNIT DISPENSER

(76) Inventor: Juan Blas Casuccio, 180 Chemin du Clos des Orangers, Saint Laurent du Var (FR), F-06700

( * ) Notice: Subject to any disclaimer, the term of this patent is extended or adjusted under 35 U.S.C. 154(b) by 0 days.

(21) Appl. No.: 10/296,169

(22) PCT Filed: May 17, 2001

(86) PCT No.: PCT/FR01/01519

§ 371 (c)(1),
(2), (4) Date: Nov. 22, 2002

(87) PCT Pub. No.: WO01/91072

PCT Pub. Date: Nov. 29, 2001

(65) Prior Publication Data

US 2003/0164379 A1 Sep. 4, 2003

(30) Foreign Application Priority Data

May 22, 2000 (FR) ..... 00 06596

(51) Int. Cl.[7] ..... G07F 11/00

(52) U.S. Cl. ..... 221/79; 221/88; 221/121; 221/123

(58) Field of Search ..... 221/79, 87, 88, 221/119, 121, 123, 274; 312/97.1

(56) References Cited

U.S. PATENT DOCUMENTS

| | | | | | |
|---|---|---|---|---|---|
| 1,691,998 | A | | 11/1928 | Smith | |
| 3,456,817 | A | * | 7/1969 | Irazoqui | 414/564 |
| 4,839,505 | A | * | 6/1989 | Bradt et al. | 235/381 |
| 4,860,876 | A | * | 8/1989 | Moore et al. | 194/205 |
| 5,984,509 | A | | 11/1999 | Scott | |
| 6,019,247 | A | * | 2/2000 | Scott | 221/88 |

* cited by examiner

*Primary Examiner*—David H. Bollinger
(74) *Attorney, Agent, or Firm*—Young & Thompson

(57) ABSTRACT

An automatic single object dispenser has storage elements provided with a drum with a horizontal axis on the periphery of which are formed receptacles radially oriented to receive each an object through an opening and a delivery zone whereat the user can collect the selected object, the drum being driven in rotation to bring the selected object to the delivery zone. The dispenser includes elements for ejecting the selected object when it reaches the delivery zone. The dispenser is useful for selling or renting out articles and in particular video cassettes or compact discs.

11 Claims, 7 Drawing Sheets

A.A.

AUTOMATIC SINGLE UNIT DISPENSER

The present invention relates to an automatic dispenser for unitary objects.

These objects could for example be videocassettes, compact discs such as audio or video compact discs, as well as any other object for multimedia use.

The invention will particularly find its application in the field of the distribution of such objects essentially within the scope of their sale or their rental.

In this field, there is known a wide network of dispensers permitting, by automatic means, the rental to the user of the object which he desires and this without need to observe business hours.

There is already known from the document FR-A-2.622.090 a vertical storage drum, for unitary objects, in vertical storage racks, open outwardly of the drum, provided with a system of automatically blocking the product contained in the compartments, by a ball system actuated by a spring.

According to this document, there is formed a drum whose axis of rotation is horizontal and which permits, about its periphery, receiving the unitary objects to be stored by the bias of the compartments.

This type of storage is particularly effective in that it permits providing a reserve of numerous objects and in that it permits, by rotation of the drums, their dispensing in a practical manner.

However, the dispensers according to the state of the art have various drawbacks.

In the first place, they do not ensure the automatic ejection of the unitary object ordered by the user when it is available.

Thus, it is at present necessary to take possession manually of the unitary object once the order has been given.

In the case in which the user does not take possession of the objects, the present dispensers do not permit replacing the object in the drum so as to keep it and cancel the operation.

However, for reasons of safety and validation of the transaction, it is important to provide the ordered object to the client and to ensure possible return to the store position if the transaction is finally cancelled.

Another drawback of the present devices is that they provide only complicated means to retain the stored objects in the compartments when they are located in the lower portion of the drum.

Thus, the document FR-A-2.622.090 proposes for each compartment a system of balls actuated by a spring adapted to retain the stored object.

This design multiplies the number of means necessary for the retention of the object and requires for each compartment the emplacement of an independent system.

Moreover, this system is not always effective particularly if the mass of the stored objects is changed.

Thus, the tension of the springs provided must be adapted to a videocassette without at the same time permitting the retention of a heavier object.

There is known from the document U.S. Pat. No. 5,984,509 an automatic system for dispensing money.

This system has the shape of a drum adapted to receive different receptacles oriented radially and adapted themselves to contain a plurality of pieces of money.

Ejection means are present to dispense the pieces of money to an outlet zone and for delivery to the client.

The retention of the pieces of money takes place by different protuberances in each of the receptacles.

There is also known from the document U.S. Pat. No. 1,691,998 a distributor comprising a plurality of receptacles in an annular zone and adapted to be matched with a delivery zone upon rotation of the annular zone.

According to this reference, the delivery zone is oriented laterally relative to the receptacles, the objects are thus, apart from the level of the delivery zone, entirely enclosed each in receptacles and are held, against the force of gravity, by one of the walls of the receptacle.

The present invention permits overcoming the drawbacks of the present dispensers. It provides, to do this, an improved automatic dispenser.

In the first place, this dispenser has the object of permitting ejection of the ordered object. It also permits a return to position of this object if the transaction is cancelled.

The present invention permits overcoming the drawbacks of present dispensers. It provides, for this purpose, an improved automatic dispenser.

In the first place, this dispenser has for its object to permit the ejection of the ordered object. It also permits a return to position of this object if the transaction is cancelled.

Another object of the invention is to ensure effective retention of the stored object about all the periphery of the drum and particularly when the objects are in the lower part of the drum.

The retention means provided are more effective than those existing at present and also less costly because of a particularly advantageous design.

Another object of the invention is to provide an automatic dispenser which will be particularly reliable. To this end, it has the advantage of providing only components of assured reliability to constitute the necessary mechanisms for the storage of the objects and for their dispensing to the user.

Other objects and advantages will become apparent from the description which follows, which is however not limiting of the invention.

The present invention relates to an automatic dispenser of unitary objects comprising storage means provided with a drum with a horizontal axis about the periphery of which are formed receptacles oriented radially each to receive an object through an opening and a dispensing zone at the level of which the user can take delivery of the ordered object, said drum being actuated in rotation to bring the ordered object to the dispensing zone. This dispenser comprises ejection means for the ordered object when it is delivered to the dispensing zone.

This dispenser could be present in the form of embodiments set forth hereafter:

- the ejection means comprise a pusher bearing on the lower surface of the ordered object and moved by translation means;
- the translation means are constituted by an electromagnet assembly whose rod is connected to the pusher by a lever arm;
- the dispensing zone comprises:
  - an opening for the passage of the ordered object from the internal volume of the dispenser toward the exterior;
  - a retractable flap for the opening or closing of the opening, retraction of the flap causing operation of the ejection means.
- the dispenser comprises retention means for the objects stored in the receptacles when their opening is oriented downwardly;
- the retention means comprise a belt extending in a plane perpendicular to the axis of the drum and bearing against the end of the stored objects at least over the lower half of the drum;
- the belt is mounted on pulleys to ensure, by their rotation, a bearing without friction of the belt against the stored objects;
- the receptacles have a height greater than that of the objects and they comprise a notch on two opposite edges of their opening so that the belt will be applied against the stored objects in the notch.

the retention means are constituted, for each receptacle, by a finger pivotally mounted on the drum between:

at rest, an abutment position below the end of the stored object;

a disengaged position when it is actuated in rotation;

the finger is actuated in rotation by at least one lug fixed relative to the drum and disposed at the level of the dispensing zone, such that it pivots the finger to free the ordered object when the finger comes to bear against the lug;

the retention means comprise, for each receptacle, an abutment adapted to slide by gravity between a retracted position when the receptacle is located in the upper portion of the drum, and an abutment position below the end of the stored objects when the receptacle is located in the lower portion of the drum;

the drum is actuated in rotation in a single direction;

the abutment of each receptacle is slidably mounted in a guide;

the longitudinal axis of the guide is inclined relative to the radial direction of the drum at the level of the receptacle, the angular offset of the longitudinal axis of the guide being oriented in the direction of rotation of the drum;

the abutment is a latch adapted to carry out a translation in a direction tangential to the drum;

the abutment coacts with a slide movable by gravity in a recess adapted to be positioned below the abutment in the rising phase of the drum to hold the abutment in position below the end of the stored objects.

The accompanying, drawings are given by way of indicative examples and are not limiting. They show a preferred embodiment according to the invention. They permit easy comprehension of the invention.

In all the figures, the unitary stored objects are indicated on the drum 3.

These unitary objects 1 are, in this case, for ease of representation, of a substantially rectangular parallelepipedal shape. However, other shapes of objects could be envisaged.

Preferably, the objects 1 are stored vertically in the direction of their largest dimension.

They are received on the drum 3 by the bias of receptacles 5.

Figure 1:
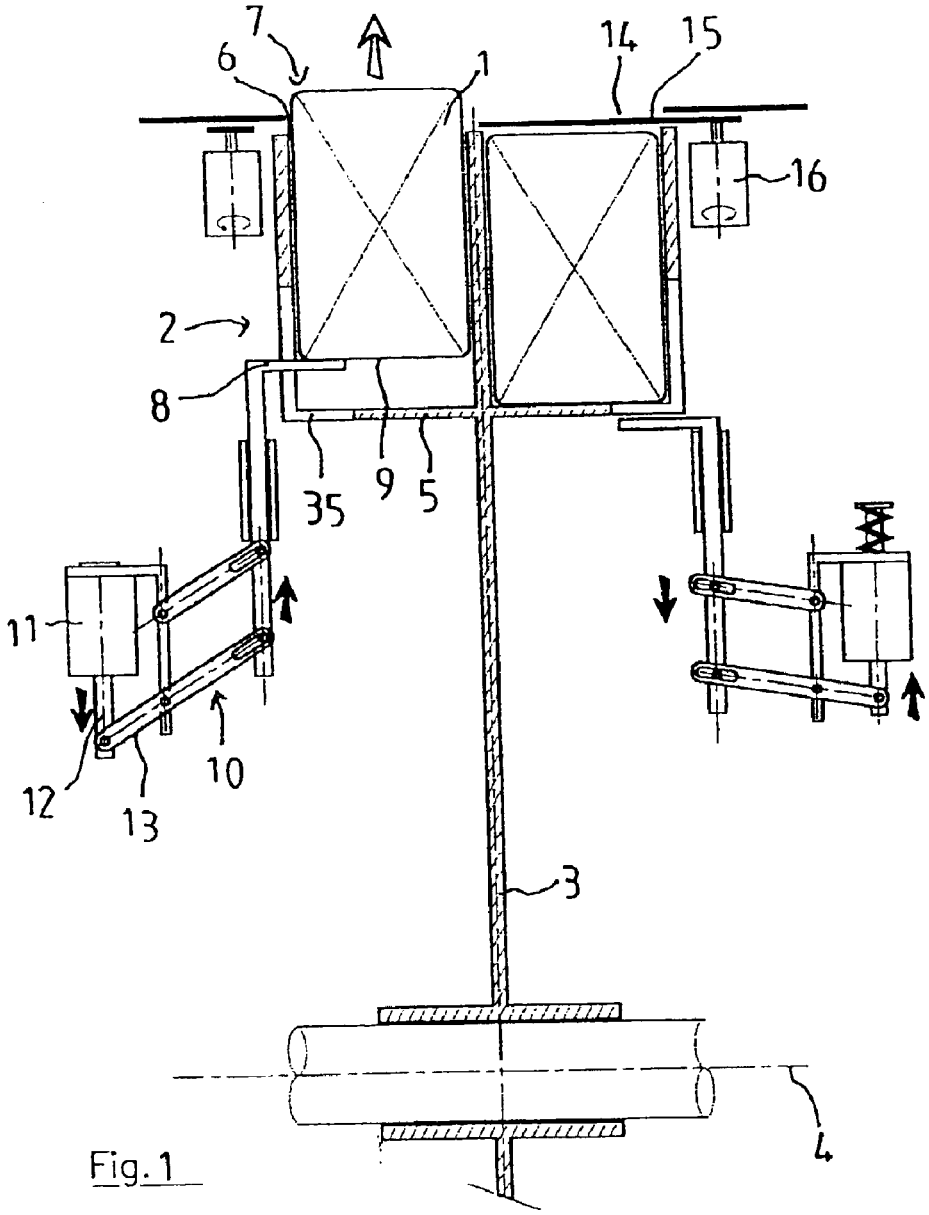
FIG. 1 shows partially the drum of the dispenser according to the invention and ejection means in a particular embodiment.

In FIG. 1, there are shown receptacles 5 of a substantially rectangular parallelepipedal shape and of a dimension slightly greater than that of the stored objects, so as to receive them. The receptacles 5 are formed on the periphery of the drum 3.

In FIG. 1, the drum 3 shown partially is constituted by an assembly mounted for rotation about a horizontal axis 4.

In the illustrated example, the drum receives side by side by the bias of two juxtaposed receptacles, two unitary objects 1.

As shown, the receptacles are oriented radially about the drum 3 and comprise an opening 6 through which the unitary objects 1 can be introduced or removed.

The shapes and dimensions of the drum 3 are not limited and particularly the number of storage rows can vary.

The external walls for protection of the dispenser have not been shown but will conventionally comprise a shell constituting the outer periphery of the dispenser and comprising a surface facing which the user can carry out the ordering operations.

This surface will comprise most often a payment and selection system for the object which it is desired to order. These various members are already used in present automatic dispensers and a current design can be selected to be used for this purpose in the scope of the invention.

The drum 3 permits storing the unitary objects 1.

Figure 2:
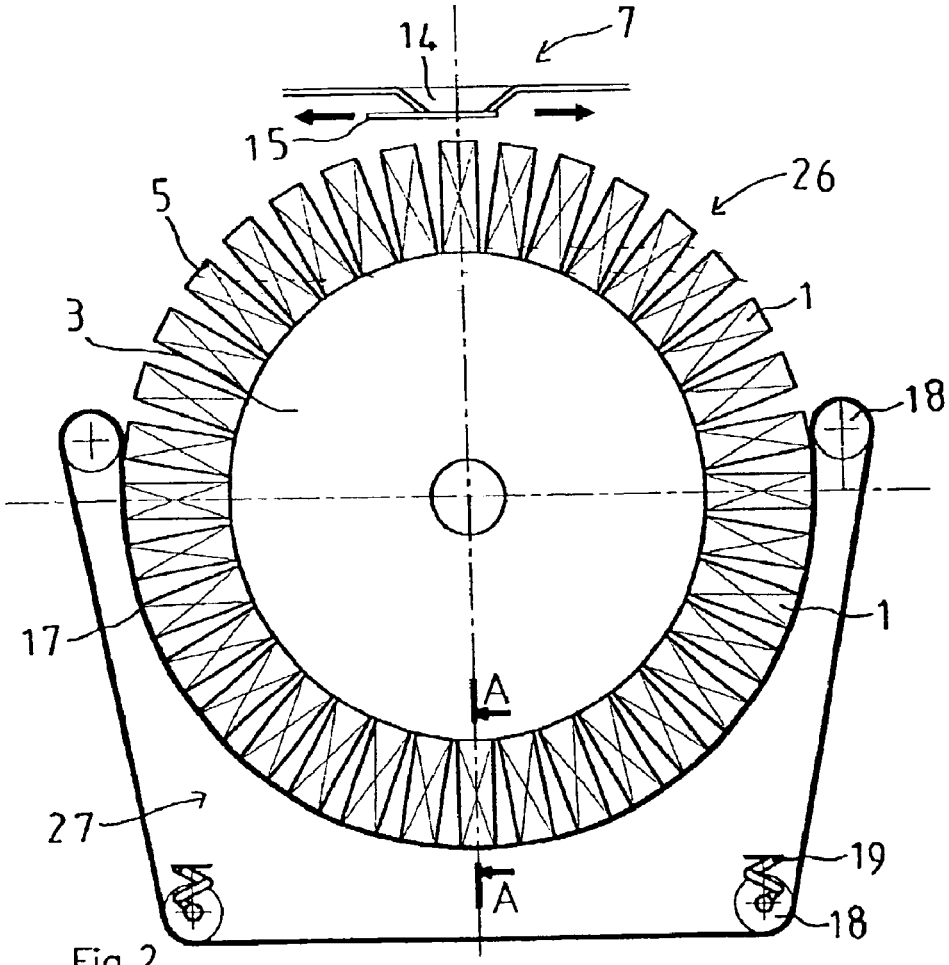
FIGS. 2 and 3 show in two different views a possibility of embodiment of the retention means for the stored objects.

To ensure delivery of the ordered object, the dispenser moreover comprises a dispensing zone indicated at 7 in FIGS. 1 and 2.

As will be seen from FIG. 2, the dispensing zone 7 comprises an opening 14 through which the ordered object can be removed from the internal volume of the dispenser.

It is at this level that the user takes delivery of the ordered object.

To ensure registry of the ordered object and the dispensing zone 7, the drum 3 is actuated in rotation by any known motor means.

Conventionally, there will be called, in the following description, the upper portion 26 of the drum 3, as the portion located substantially above the horizontal medial plane of the drum as is shown in FIG. 2.

By analogy, the lower portion 27 also shown in FIG. 2, is the portion of the drum 3 located below the horizontal medial plane of the drum 3.

This delimination must not however be strictly applied in the sense that the lower portion 27 can rise beyond the horizontal medial plane of the drum 3.

According to the invention, the means for rejection of the ordered object are formed to dispense the latter to the user when it arrives at the dispensing zone 7.

A particular embodiment of these ejection means is shown in FIG. 1.

In this framework, a pusher 8 presses on the lower surface 9 of the object 1.

The pusher is moreover actuated in translation so as to transmit its movement to the unitary object.

The latter is thus therefore at least partially extracted from the receptacle 5.

As shown, translation means 10 are constituted to move the pusher 8. The latter bears on the lower surface 9 by the bias of a passage 35 constituted in the lower portion of the receptacle 5 as shown in FIG. 1.

The translation means 10 can be constituted in various ways and particularly by an electromagnetic assembly 11 whose rod 12 is connected to the pusher 8 by the bias of a lever arm 13.

The presence of this lever arm 13 ensures a demultiplication of the force applied by the pusher 8 to the unitary object 1. In this way, the ejection means are reliably constituted whilst minimizing the power necessary for the electromagnet 11.

Preferably, the dispensing zone 7 is not accessible by the user when the latter has not yet given his order.

To obstruct the dispensing zone 7 in the rest position, the dispenser will preferably comprise, at the level of dispensing zone 7, a retractable flap 15 adapted to open or close an opening 14 formed in the dispensing zone 7.

It will be understood in this respect that the ejection means can operate only if the flap 15 is retracted.

The example illustrated in FIG. 2 shows retraction of the flap 15 by translation.

This can also take place by the bias of a rotation such as that shown in FIG. 1 in which rotatable retraction means 16 are shown.

To ensure effective operation of the storage means, it is necessary to retain the objects 1, present in the receptacles 5. This retention is carried out by means of the lower portion 27 of the drum 3.

The present invention provides several modified embodiments of the retention means.

Figure 3:
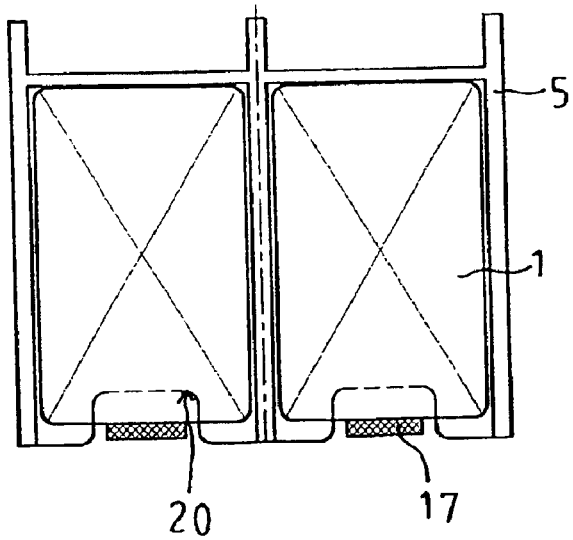

According to a first modification, the retention means comprise a belt shown by reference 17 in FIGS. 2 and 3.

It will be noted that the belt 17 is applied in its longitudinal direction in a plane perpendicular to the axis 4 of the drum 3.

It bears against the end of the stored objects 1, said end being that located opposite the lower surface 9.

FIG. 3 shows in cross-section the embodiment of two belts 17 positioned parallel to each other to hold the stored objects in two series of receptacles 5 located in parallel about the periphery of the drum 3.

Preferably, the belt 17 is applied without friction to the end of the objects 1. To do this, the dispenser will comprise pulleys 18 permitting the guidance and rotation of the belt 17 in the course of the rotation of the drum 3.

Four pulleys 18 as shown in FIG. 2 could be used.

Moreover, to adjust the tension of the belt 17, a suspension system 19 could be used to suspend at least two pulleys 18.

This modified embodiment of the retention means is particularly effective in the sense that fewer constituent pieces are necessary to provide the retention means.

There is thus provided a particularly reliable and low cost assembly.

Preferably, the receptacles 5 have a height greater than that of the stored objects 1 and they comprise, at the level of their opening 6, a notch 20 as shown in FIG. 3.

There is thus there shown a notch 20 constituted on two opposite edges of the opening 16 such that the belt 17 will be applied in the notch 20 against the stored objects 1.

In this way, supplemental guidance of the belt 17 is constituted, which avoids any mis-operation.

According to another modification, the retention means are a finger 21 pivotally mounted on the drum 3, and this for each receptacle 5.

Figure 4:
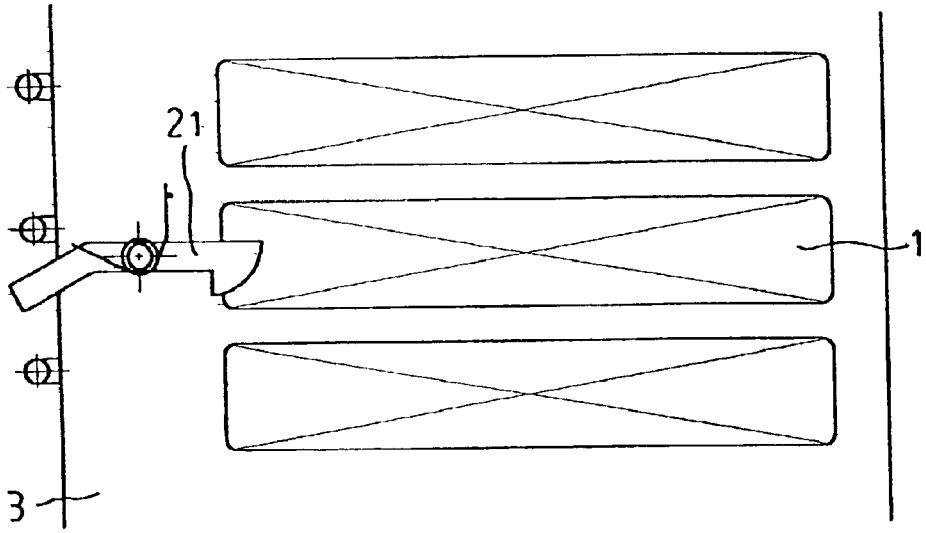
FIGS. 4 and 5 show another embodiment of the retention means for the stored objects.
Figure 5:
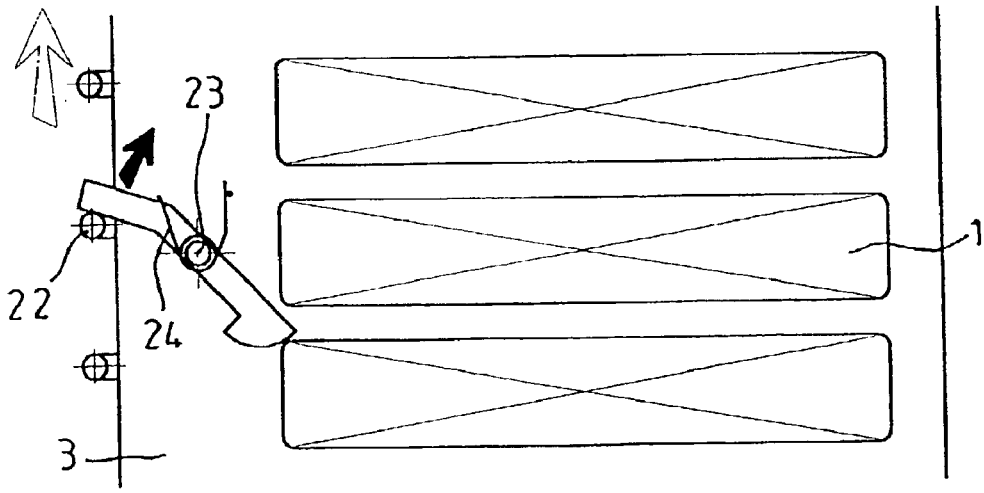

This embodiment is particularly present in FIGS. 4 and 5.

There will be seen there a finger 21 of which one portion is applied below the end of the stored object 1. It should be understood that a finger 21 is necessary to retain each stored object 1.

In a rest position shown in FIG. 4, the finger 21 is positioned below the end of the stored objects 1 so as to constitute an abutment.

The finger 21 can however have another position shown in FIG. 5, in which it is disengaged so as to free the object 1.

This actuation, by disengaging the finger 21, can be carried out by the bias of a lug 22 mounted fixedly relative to the drum 3 and disposed substantially at the level of the dispensing zone 7.

In this way, when the stored object 1 reaches the level of the dispensing zone 7, the lug 22 is applied against the finger 21 so as to cause it to pivot.

Preferably, the pivot connection is provided about a pivot axis 23 and the return spring 24 ensures the return to rest position of the finger 21.

According to another modification, the retention means comprise, for each receptacle 5, an abutment 25 as shown in FIGS. 6 to 9.

In this case, there is used the movement by gravity of the abutment 27 to ensure its emplacement below the end of the object, when these latter are in the lower portion 27.

Again by gravity, the abutment 27 can be retracted from the end of the objects 1, when the object 1 is located in the upper portion 26 of the drum 3.

Figure 6:
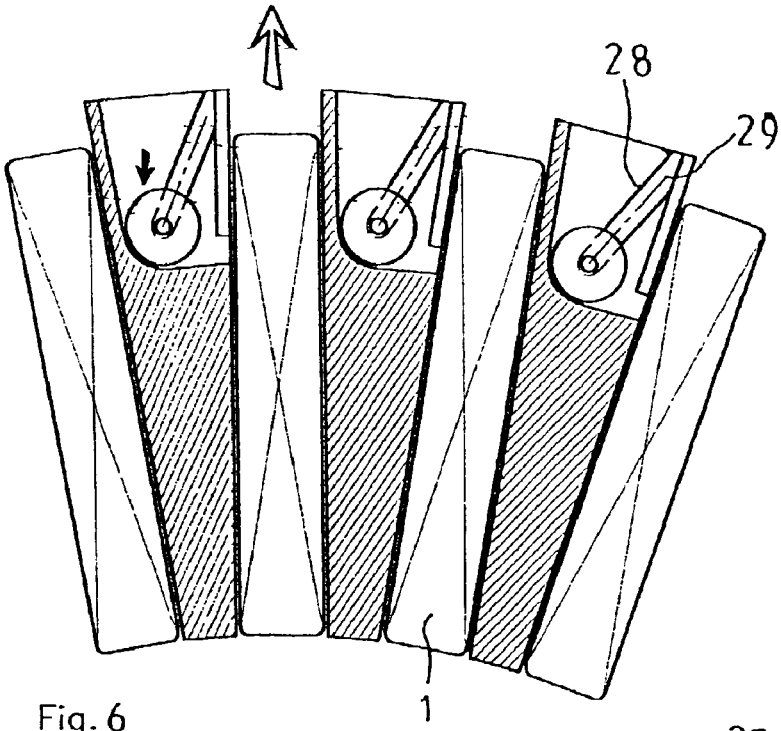
FIGS. 6 to 9 show, in the course of various phases of rotation, a particular embodiment of the retention means in the form of an abutment.

In FIG. 6, it will be noted that the abutment 25 is in the retracted position when the receptacle 5 is located in the upper portion 26 of the drum 3.

In this case, the object 1 is not held and can easily be delivered to the user.

Figure 7:
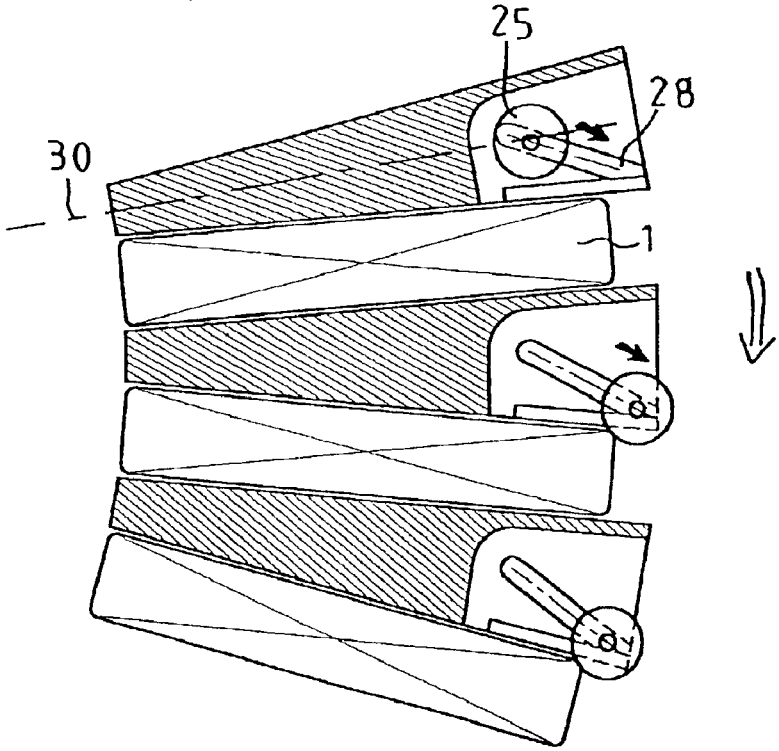

When the rotation of the drum continues, for example in the clockwise direction as shown in FIG. 7, it is necessary, in a predetermined angular position, to ensure the emplacement of the abutment 25 below the end of the objects 1.

This emplacement takes place as shown, by a movement by gravity, and by sliding of the abutment 25.

Figure 9:
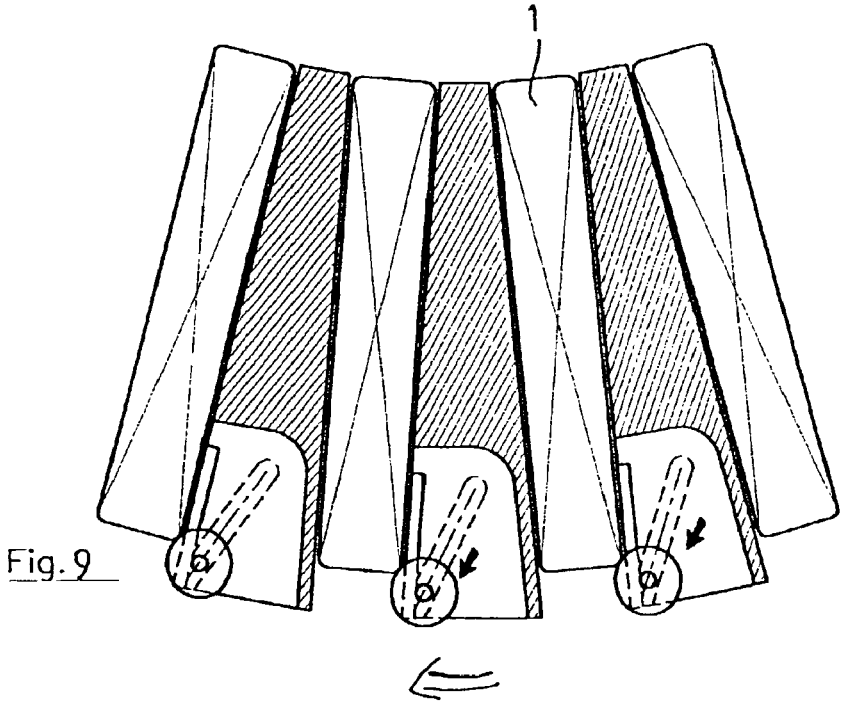

It will be seen in FIG. 9 that the objects 1 are perfectly retained when they are located in the lower portion 26.

Figure 8:
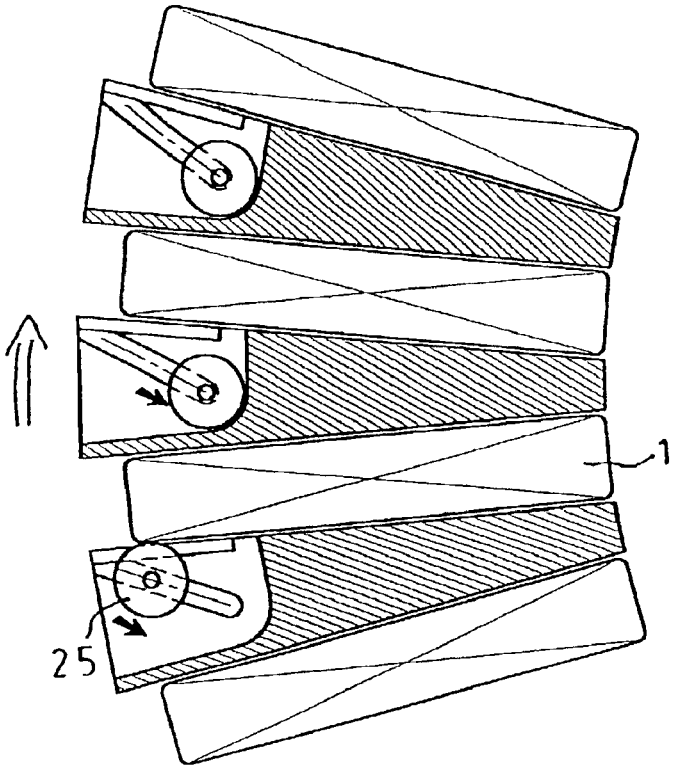

In FIG. 8 it is also shown that, in the course of rising, the abutment 25 retracts.

It will be noted that, according to the embodiment shown in FIGS. 6 to 9, the abutment 25 is slidably mounted by the bias of a guide 28.

Moreover, the longitudinal axis 29 of the guide 28 is inclined relative to the radial direction of the drum 3 at the level of the receptacle 5.

The radial direction of the drum 3 is shown at 30 in FIG. 7.

There is provided an angular offset between the longitudinal axis 29 and the direction 30 such that the longitudinal axis 29 will be in advance of the direction 30 in the course of rotation of the drum 3.

Of course, this embodiment requires always using a single direction of rotation. In the case of the example, there is shown purely for indicative purposes, a clockwise rotation.

In the case of rotation in a trigonometric direction, the angular offset of the longitudinal axis 29 and of the radial direction will be reversed.

According to an embodiment of the abutment 25 shown in FIGS. 10 to 13, the abutment 25 is constituted by a latch shown at 31.

As shown, the latch 31 can move in a direction radial to the drum and this to position itself either below the end of the objects 1, or in the retracted position.

Figure 10:
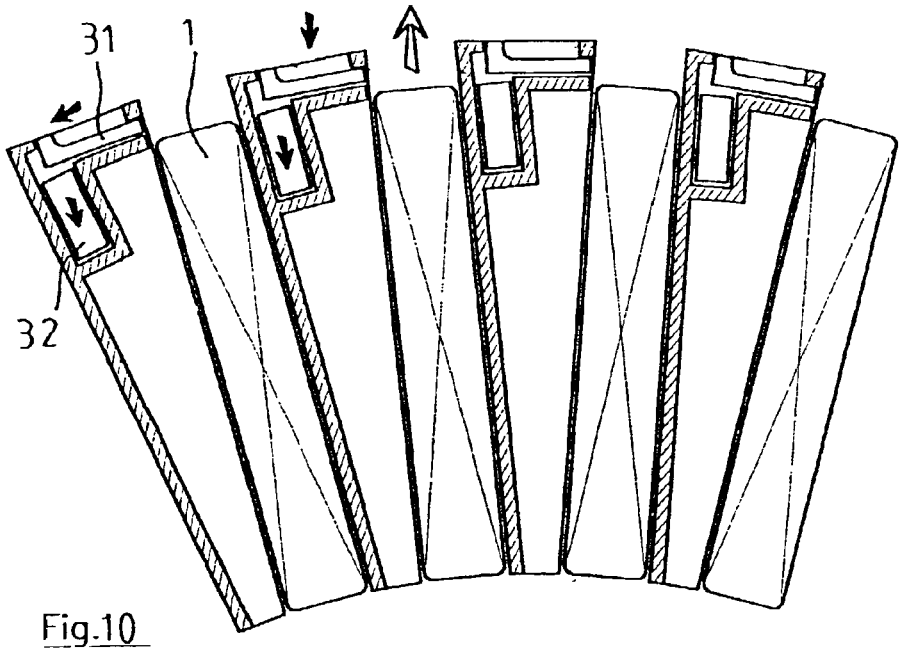
FIGS. 10 to 13 show schematically in the course of different steps of rotation of the drum, another particular embodiment of the retention means for the stored objects.
Figure 11:
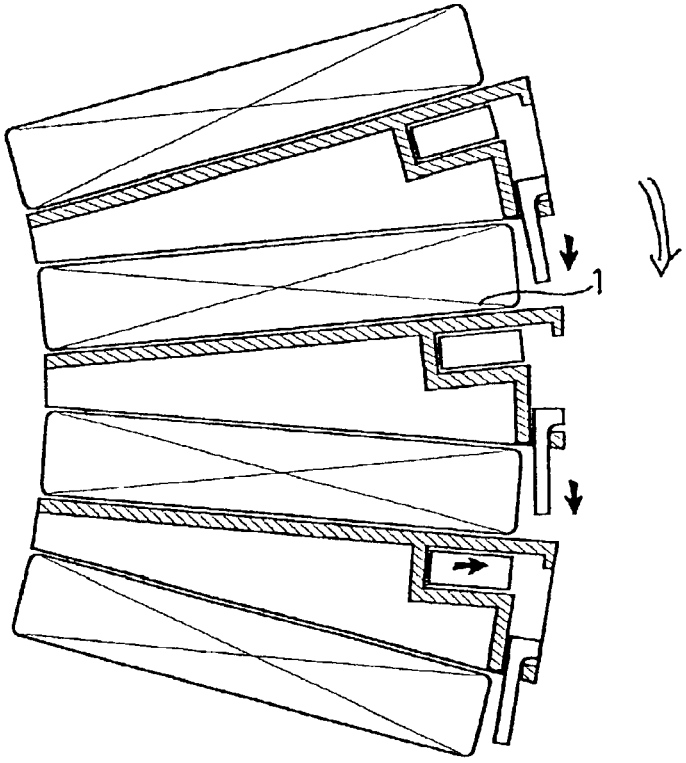

FIG. 10 shows the latches 31 in retracted position whilst FIG. 11 shows the latches in position below the objects 1.

As in the case shown in FIGS. 6 to 9, the sliding of the latch 31 takes place by the action of gravity.

However, in the present case, it is necessary to hold, in the abutment position, the latch 31 in the course of the rising phase of the drum 3.

In this case, the retention means comprise, in addition to the abutment 25, a slide 32 also movable by gravity.

Figure 13:
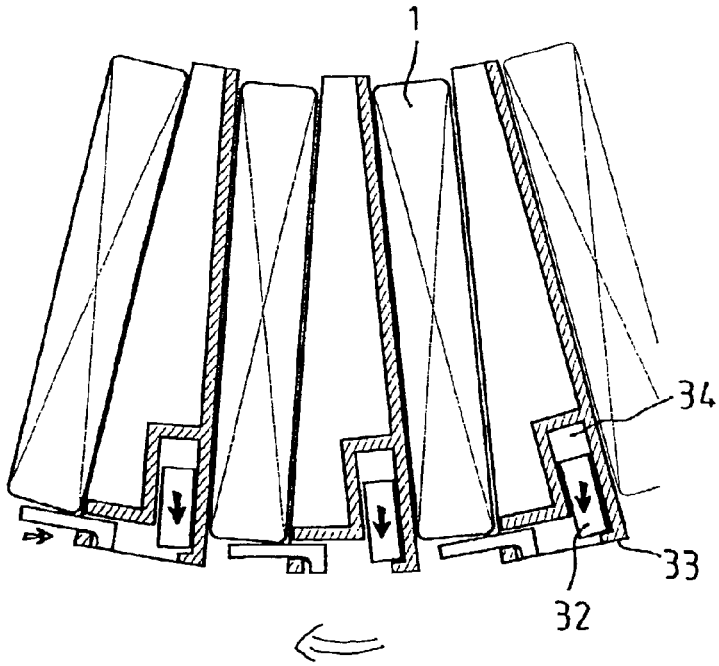

As shown in FIG. 13, the movement of the slide 32 takes place in a recess 34 which can be partially closed by an edge 33.

FIG. 13 shows that upon arriving in the lower portion of the drum, the slide 32 falls by gravity and bears against the edge 33.

Figure 12:
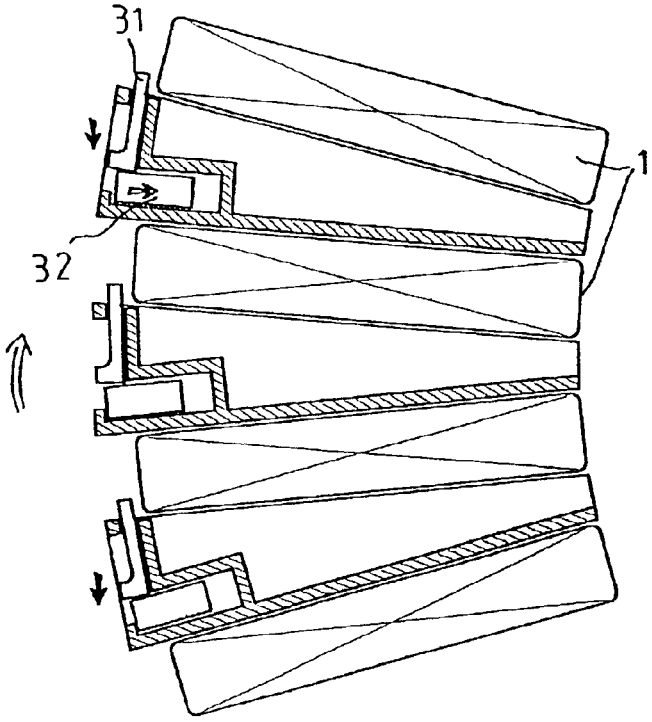

In FIG. 12 it will be easily seen that in the course of rising of the drum 3, the latch 31 has the tendency to fall again but is held in abutment position below the end of the objects 1 by bearing on the slide 32.

As in the case of FIGS. 6 to 9, there has been chosen for the example a single rotation direction of the drum 3, in the clockwise direction.

Similarly, it is possible to transpose the description to a trigonometric direction of rotation.

It suffices, to do this, to reverse the position of the latches 31 relative to the receptacle 5.

The latch 31 could be constituted in various ways and will comprise, as shown, for example, a substantial L shape whose larger length provides the abutment element and whose lesser length provides retention of the latch 31.

Although it is not limiting, the retention means provided in the present text are of a largely mechanical design, which ensures high reliability of operation and good life for the dispenser.

References

1. Stored objects
2. Storage means
3. Drum
4. Drum axis
5. Receptacle
6. Opening
7. Dispensing zone
8. Pusher
9. Lower surface
10. Movement means
11. Electromagnet
12. Rod
13. Lever arm
14. Opening
15. Flap
16. Retraction means
17. Belts
18. Pulleys
19. Suspension
20. Notch
21. Finger
22. Lug
23. Pivot axis
24. Return spring
25. Abutment
26. Upper portion
27. Lower portion
28. Guide
29. Guide axis
30. Radial direction
31. Latch
32. Slide
33. Edge
34. Recess
35. Passage

What is claimed is:

1. Automatic dispenser for unitary objects (1) comprising storage means (2) provided by a drum (3) with a horizontal axis (4) about the periphery of which are formed receptacles (5) oriented radially each to receive an object through an opening (6) and a dispensing zone (7) in which the user can take delivery of the ordered object, said drum (3) being rotatable to bring the ordered object to the dispensing zone (7), said distributor comprising:

ejection means for ejecting the ordered object through said opening when it is brought to the dispensing zone (7);

retention means for retaining the stored objects (1) in the receptacles (5) when their opening (6) is oriented downwardly;

characterized by the fact that the retention means comprise a belt (17) extending in a plane perpendicular to the axis (4) of the drum (3) and bearing against the ends of the stored objects (1) at least over the lower half of the drum (3).

2. Automatic dispenser according to claim 1 characterized by the fact that the belt (17) is mounted on pulleys (18) to ensure, by their rotation, a bearing without friction of the belt (17) against the stored objects (1).

3. Automatic dispenser according to claim 2 characterized by the fact that the ejection means comprise a pusher (8) bearing on the lower surface (9) of the ordered object and moved by translation means (10).

4. Automatic dispenser according to claim 2 characterized by the fact that the dispensing zone (7) comprises:

an opening (14) for the passage of the ordered object from the internal volume of the dispenser toward the outside;

a retractable flap (15) for the opening or closing of the opening (14), and means (16) to open or close the flap (15).

5. Automatic dispenser according to claim 1 characterized by the fact that the ejection means comprise a pusher (8) bearing on the lower surface (9) of the ordered object and moved by translation means (10).

6. Automatic dispenser according to claim 5 characterized by the fact that the translation means (10) are constituted by an electromagnet (11) having a rod (12) reciprocated by said electromagnet (11) and connected to the pusher (8) by a lever arm (13).

7. Automatic dispenser according to claim 5 characterized by the fact that the translation means (10) are constituted by an electromagnet (11) having a rod (12) reciprocated by said electromagnet (11) and connected to the pusher (8) by a lever arm (13).

8. Automatic dispenser according to claim 5 characterized by the fact that the dispensing zone (7) comprises:

an opening (14) for the passage of the ordered object from the internal volume of the dispenser toward the outside;

a retractable flap (15) for the opening or closing of the opening (14), and means (16) to open or close the flap (15).

9. Automatic dispenser according to claim 6 characterized by the fact that the dispensing zone (7) comprises:

an opening (14) for the passage of the ordered object from the internal volume of the dispenser toward the outside;

a retractable flap (15) for the opening or closing of the opening (14), and means (16) to open or close the flap (15).

10. Automatic dispenser according to claim 1 characterized by the fact that the dispensing zone (7) comprises:

an opening (14) for the passage of the ordered object from the internal volume of the dispenser toward the outside;

a retractable flap (15) for the opening or closing of the opening (14), and means (16) to open or close the flap (15).

11. Automatic dispenser according to claim 1 characterized by the fact that the receptacles (5) have a height greater than that of the objects (1) and that they comprise a notch (20) over two opposite sides of their opening (6) so that the belt (17) will bear against the stored objects in the notch (20).

* * * * *